US006168551B1

(12) United States Patent
McGuinness

(10) Patent No.: US 6,168,551 B1
(45) Date of Patent: Jan. 2, 2001

(54) SURFING SIMULATOR AND METHOD USING INFLATABLE BLADDERS

(76) Inventor: Matthew McGuinness, 2615 Manhattan Ave., Hermosa Beach, CA (US) 90254

( * ) Notice: Under 35 U.S.C. 154(b), the term of this patent shall be extended for 0 days.

(21) Appl. No.: 08/927,665

(22) Filed: Sep. 10, 1997

(51) Int. Cl.[7] ..... A63B 22/16; A63B 69/00

(52) U.S. Cl. ..... 482/51; 482/146; 472/134; 472/135; 434/247

(58) Field of Search ..... 482/34, 51, 77, 482/79, 71, 112, 146, 148, 26; 434/46, 55, 247, 253, 258; 472/127–130, 134, 135, 115, 106; 273/449

(56) References Cited

U.S. PATENT DOCUMENTS

| | | | | |
|---|---|---|---|---|
| 2,978,243 | * | 4/1961 | Gabrielson | 472/135 |
| 3,863,915 | * | 2/1975 | Pifer | 482/51 |
| 4,159,826 | * | 7/1979 | Hancock | 482/26 |
| 4,516,768 | * | 5/1985 | Gallaro | 482/26 |
| 4,534,124 | * | 8/1985 | Schnell | 482/51 |
| 4,749,180 | * | 6/1988 | Boomer | 482/51 |
| 4,817,950 | * | 4/1989 | Goo | 482/146 |
| 4,850,588 | * | 7/1989 | Desjardins et al. | 482/51 |
| 5,048,823 | * | 9/1991 | Bean | 482/146 |
| 5,062,629 | * | 11/1991 | Vaughan | 482/51 |
| 5,112,045 | * | 5/1992 | Mason et al. | 482/146 |
| 5,279,528 | * | 1/1994 | Dalebout et al. | 482/54 |
| 5,429,562 | * | 7/1995 | Milner | 482/51 |
| 5,509,871 | * | 4/1996 | Giovanni | 482/51 |
| 5,769,725 | * | 6/1998 | Ogden et al. | 472/134 |
| 5,851,166 | * | 12/1998 | Bernardson | 482/79 |

FOREIGN PATENT DOCUMENTS

| | | | | |
|---|---|---|---|---|
| 2214401 | * | 9/1989 | (GB) | 482/51 |

OTHER PUBLICATIONS

Kleer Shapes, Flaghouse, Inc. Special Populations Spring 1995 catalog, p. 8.*

* cited by examiner

*Primary Examiner*—John Mulcahy
*Assistant Examiner*—Victor K. Hwang
(74) *Attorney, Agent, or Firm*—Jeffrey D. Sullivan

(57) ABSTRACT

This invention uses a plurality of inflatable bladders to support a surfboard or other balancing platform or sport board. The bladders are inflated with a gas or liquid, and as such, provide a fluid medium on which to seat a surfboard. This type of support system provides a sensation similar to that of water. This type of support system also allows for adjustments in the stability of the balancing platform. When used with a surfboard, snowboard, or other delicate standing platform, this type of support system evenly distributes the user's weight-load across a large area of the surfboard, snowboard, or other delicate platform so that it is not damaged.

18 Claims, 3 Drawing Sheets

SURFING SIMULATOR AND METHOD USING INFLATABLE BLADDERS

BACKGROUND OF THE INVENTION

The present invention relates to a device and method for the simulation of sports requiring balance on a board. More particularly, the present invention relates to a device and method for simulating the sport of surfing.

It is well known that surfing requires advanced balancing skills on a relatively unstable board. Surfing also requires the ability to quickly move from a prone position (on your stomach) to a standing position. It is difficult for surfers to practice these skills when surfing in the ocean since the majority of a surfer's time is spent in the prone position paddling with his or her arms trying to maintain the correct location just seaward of the area of breaking waves, or surf zone. When a surfer wants to catch a wave and stand up, he/she must paddle with that wave into the surf zone. Once a surfer is in the surf zone it is physically demanding to get back to the area just seaward of the surf zone suitable for catching waves. Surfers, particularly novice surfers, have difficulty paddling in and out of the surf zone without becoming exhausted. Thus, the surf zone does not allow surfers the luxury of repeatedly practicing the movement from the prone position to the standing position without physically exhausting them by forcing excessive paddling through the surf zone. Accordingly, by simulating the stability and feel of a surfboard as it moves through the water in the surf zone, a surfing simulator would allow a person to practice the movement from prone position to standing position, and, balancing in the standing position, as if surfing.

Some prior art surfing simulators have been created which use external forces from motors, pumps, levers, and the like, to actively generate motion and tilting angles in a surfboard-like standing platform. However, when surfing, the movement of a surfboard is largely governed by changes in foot positioning and foot pressure applied by the surfer. Prior art surfing simulators which generate board motion independent of, and not subject to, the rider's foot positioning and foot pressure are better suited as arcade-type rides and do not generally simulate the actual sensation of surfing. In addition to their failure at realistically simulating the surfing sensation, motor-driven surfing simulators are typically too complicated, too large, and too expensive for individual, at-home users. Examples of such prior art mechanical surfing simulators which generate movement in a dedicated surfboard-like standing platform include U.S. Pat No. 5,429,562 issued to Graham Milner, U.S. Pat. No. 4,749,180 issued to Ted Boomer, and U.S. Pat. No. 4,850,588 issued to Gilles Desjardines.

Other prior art surfing simulators use an arrangement of springs connected to a base platform and a standing platform. However, these spring or bias forces are not readily adjustable by the user so that the user can easily make minor or delicate changes in the types of waves they want to simulate. These prior art simulators also require a special non-surfboard standing platform, or, a surfboard which is dedicated to the simulator and is not capable of being removably attached without damaging the surfboard. Some prior art spring-mounted simulators use platforms that may be modified into holding trays for a surfboard; however, these holding trays are too rigid to place a surfboard on without damaging the surfboard. Since modern surfboards are constructed of a Styrofoam core wrapped in a fiberglass shell and are highly susceptible to dents and fractures of the fiberglass, prior art simulators which use rigid holding trays do not provide an adequately malleable surface to seat a surfboard without causing damage to the board. Moreover, these spring bias simulators are not easily portable. Further, surfing simulators using springs are also subject to the spring system's natural tendency to increase it's bias to return to a neutral position as the spring is increasingly flexed. This tendency is not representative of a surfboard in the water. Further, such prior art surfing simulators using springs have no provision for preventing a surfboard on a base mounted spring from being bent over until the surfboard strikes the base or the ground, providing an unrealistic jolt to the user. Further still, a spring-mounted surfboard could violently and dangerously snap back to the neutral position, injuring a user. Prior art mechanical surfing simulators using springs include U.S. Pat. No. 5,509,871 issued to Chris San Giovanna, U.S. Pat. No. 5,062,629 issued to Jeffrey R. Vaughan, and U.S. Pat. No. 3,863,915 issued to Harry J. Pifer.

U.S. Pat. No. 5,048,823 issued to John A. Bean on Sep. 17, 1991 teaches a balance board supported by one semi-bulbous member. The bulbous member however is not controllably adjustably by the user so that the user can simulate different surfing environments. Moreover, the balance board does not have a means to stop itself from rolling completely to the side and throwing the user therefrom. In addition, the balance board requires a special standing platform (as opposed to an actual surfboard) that is dedicated to the simulator, (i.e., permanently affixed) and not capable of being removably attached and used in the water.

U.S. Pat. No. 4,516,768 issued to Carmelo Gallaro on May 14, 1985 and U.S. Pat. No. 4,159,826 issued to John J. Hancock on Jul. 3, 1979 disclose the use of inflatable tubes for jogging.

None of the above-referenced prior art designs have been successfully mass marketed to the individual-user surfing community. In particular, a surfer looking to improve his or her skills has not been able to easily obtain a simulator which closely simulates the feel of a surfboard in the water or that allows use of actual surfboards without causing damage to the surfboards so that they may be removably attached and used in the ocean as well.

In light of the above, it would be desirable to be able to:

(a) provide a surfing simulator and method which can be used in conjunction with a removably attached surfboard which will not damage the surfboard;

(b) provide a surfing simulator and method which simulates more closely the feel of a surfboard in water;

(c) provide a surfing simulator and method that offers a high degree of side to side motion without allowing the surfboard to contact the ground and damage the surfboard or cause the user to be thrown off the board;

(d) provide a surfing simulator and method which is portable and allows a surfer to readily practice on their own individual boards without damaging their boards;

(e) provide a surfing simulator and method which is adjustable and controllable by the user so as to be able to simulate beginning, intermediate or advanced surfing conditions by adjusting the fore-and-aft and side-to-side stability;

(f) provide a surfing simulator and method which can accommodate a wide variety of sizes, including "long-boards" and "shortboards";

(g) provide a surfing simulator that can be easily stored and transported; and (h) to provide a surfing simulator which will be inexpensive to produce and capable of use by individual users.

SUMMARY OF THE INVENTION

It is an object of this invention to provide a device and method for (a) surfing simulation which can be used in conjunction with a removably attached surfboard which will not damage the surfboard;

(b) surfing simulation which simulates more closely the feel of a surfboard in water;

(c) surfing simulation that provides a high degree of side to side motion without allowing the surfboard to contact the ground and damage the surfboard or throw the user off the board;

(d) surfing simulation which is portable and allows a surfer to readily practice on their own individual boards without damaging their boards;

(e) surfing simulation which is adjustable and controllable by the user so as to be able to simulate beginning, intermediate or advanced surfing conditions by adjusting the fore-and-aft and side-to-side stability;

(f) surfing simulation which can accommodate a wide variety of surfboards, including "longboards" and "shortboards";

(g) surfing simulation where the simulator can be easily stored and transported; and (h) surfing simulation where the simulator is inexpensive to produce and capable of use by individual users.

In accordance with the present invention there is provided a simulator device for training a user to balance on a board comprising: (a) an inflatable bladder having an upper surface adapted to allow the board to be removably supported thereon; (b) a restraining member to restrain said inflatable bladder; and (c) a means to adjust the level of inflation in said inflatable bladder so as to allow the user to control the simulation.

The present invention also includes a method for training a user to balance on a board comprising the steps of: (a) providing an inflatable bladder having an upper surface adapted to allow the front of the board to be removably supported thereon; (b) placing the board on the bladder; and (c) adjusting the level of inflation of said bladder to accommodate the user's level of skill.

BRIEF DESCRIPTION OF THE DRAWINGS

The above and other objects and advantages of the invention will be apparent upon consideration of the following detailed description, taken in conjunction with the accompanying drawings, in which like reference numerals refer to like-parts throughout, and in which.

BRIEF DESCRIPTION OF THE REFERENCE NUMERALS

Figure 1:
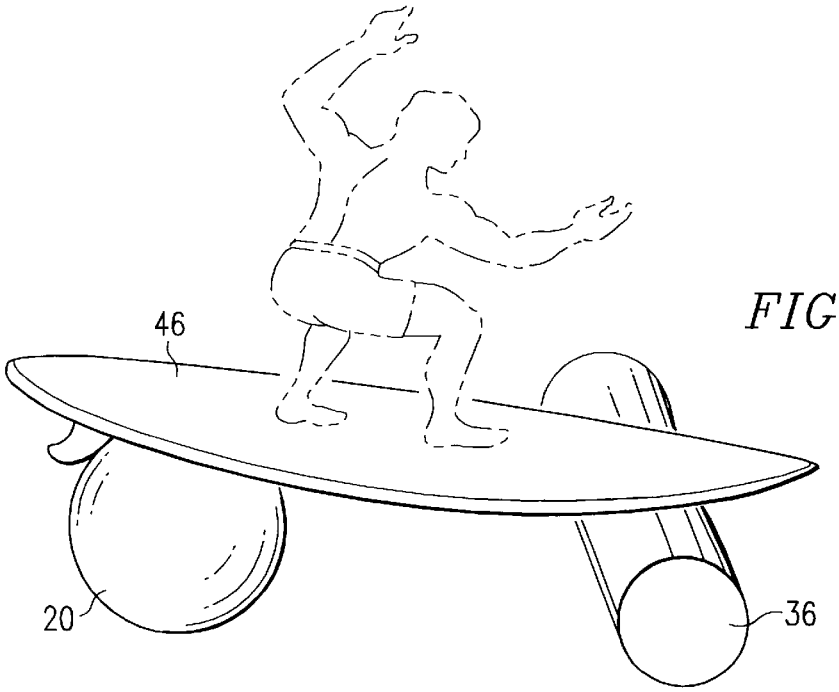
FIG. 1 is an illustrative drawing showing a first embodiment of the surfing simulator device of the present invention.

In conjunction with the above drawings and the ensuing detailed description, the following is a brief description of the reference numerals used herein:

10 back support;

12 front support;

14 back support non-skid pad;

16 back support bladder restraining member;

20 back support inflatable bladder;

24 back support inflatable bladder valve;

26 back support restraining member grommet;

28 back support retaining strap;

30 front support non-skid pad;

32 front support bladder restraining member;

36 front support inflatable bladder;

38 front support inflatable bladder valve;

40 front support grommet;

42 front support retaining strap;

44 front support nose retaining strap; and

46 surfboard.

DETAILED DESCRIPTION OF THE INVENTION

FIG. 1 is an illustrative drawing showing a first embodiment of the surfing simulator device of the present invention, including a rear inflatable bladder 20, a front inflatable bladder 36 and a surfboard 46 which is positioned on top of inflatable bladders 20 and 36. As shown in FIG. 1, front inflatable bladder 36 is positioned so that when fully inflated its top is relatively flat over a span greater than the width of surfboard 46. Therefore, when inflated to a relatively high level, front inflatable bladder 36 provides a relatively flat, semi-rigid platform for the front of surfboard 46. This flat, semi-rigid platform reduces the surfboard's ability to roll side-to-side. Conversely, when front inflatable bladder 36 is partially deflated, it becomes semi-flaccid and surfboard 46 is more readily able to roll side-to-side in the amount of the slack in the semi-flaccid bladder.

Rear inflatable bladder 20 is spherically shaped (for this embodiment), and as such, rises to a relative apex where surfboard 46 is positioned on top of it. The higher the level of inflation in rear bladder 20 the higher the rear of surfboard 46 is elevated. In addition, the higher the level of inflation in rear bladder 20 the more pronounced the relative apex (to reduce the area of contact) when the weight of surfboard 46 is positioned on top of it. Thus, the higher the level of inflation in rear bladder 20 the more pronounced the relative apex becomes (to reduce the area of contact) and the more surfboard 46 can rock side-to-side.

These principles of side-to-side bias and elevational variability through the inflation and deflation of bladders provide a way to closely simulate various surfing conditions and provide a more water-like feel and will be discussed further below in connection with other embodiments of the present invention.

Figure 2:
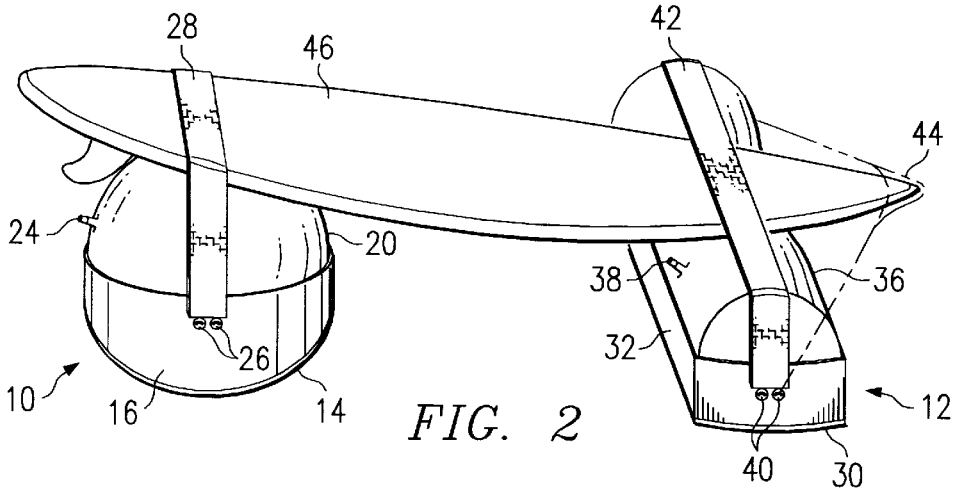
FIG. 2 is a side perspective view of a second embodiment of the surfing simulator device.

A second embodiment of the surfing simulator of the present invention is shown from a side perspective view in FIG. 2. This embodiment of the simulator is divided into two separate supports, a back support, designated generally by reference numeral 10, and a front support, designated generally by reference numeral 12.

Back support 10 includes a non-skid pad 14 on the bottom of a bladder restraining member 16. Bladder restraining member 16 is shaped like a tube (in this particular embodiment) and oriented vertically so non-skid pad 14 rests on the ground and the aperture of the tube faces up. Bladder restraining member 16 can be made of plastic or other semi-rigid materials. (One embodiment of bladder restraining member 16 can be the top half of an outdoor garbage receptacle). A spherical rear inflatable bladder 20 made of rubber, vinyl or the like is seated in the aperture of bladder restraining member 16. (If desired, one embodiment of spherical bladder 20 can be a 65 centimeter Sissel™ Superior Backball used for physical therapy, manufactured by Sissel of Germany). Enough of spherical inflatable bladder 20 rests in the lumen of bladder restraining member 16 so that it seats securely while the remaining portion of spherical bladder 20 rises above the upper edge of bladder restraining member 16. A valve 24 on spherical bladder 20 allows for inflation and deflation to allow for adjustment in elevation and side to side stability. Grommets 26 on the sides of bladder restraining member 16 are used to attach a back support retaining strap 28 which goes over a surfboard 46 and holds it to spherical bladder 20 (to the extent one desires to use such a strap).

Front support 12 includes a non-skid pad 30 on the bottom of a front bladder restraining member 32. Bladder restraining member 32 can be made of plastic or other semi-rigid materials. Bladder restraining member 32 is a rectangularly shaped tray (in this particular embodiment). An elongated inflatable bladder 36 made of rubber, vinyl or the like is seated in the aperture of bladder restraining member 32. (If desired, one embodiment of elongated bladder 36 can be an inflatable bench used in inflatable river rafts.) Elongated bladder 36 has an upper surface that is relatively flat with respect to the beam (width) of surfboard 46 and generally wider than surfboard 46. A valve 38 allows for inflation and deflation of elongated bladder 36 to provide for adjustability in side-to-side roll. Grommets 40 on bladder restraining member 32 are used to secure a front retaining strap 42 which goes over surfboard 46 and holds it to elongated bladder 36 (to the extent it is desired to use one). Grommets 40 are also used to attach an optional nose retaining strap 44 for securing the nose of the surfboard.

Figure 3:
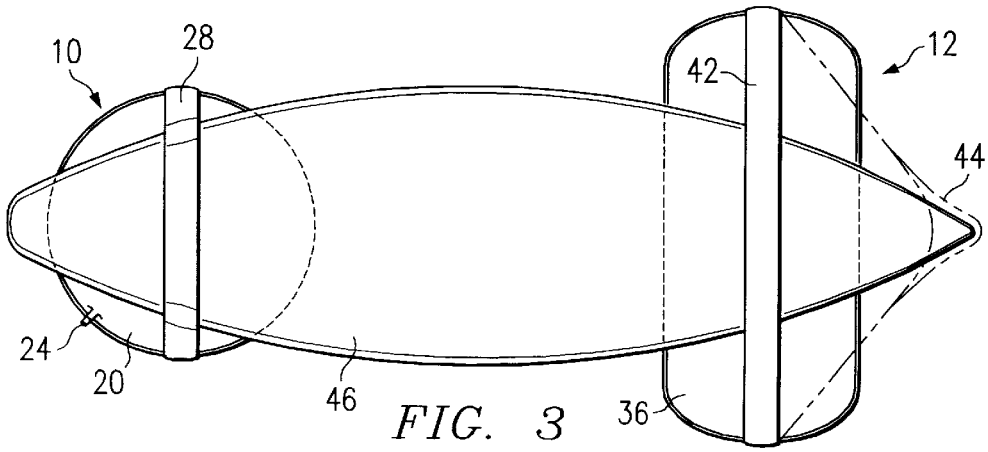
FIG. 3 is an overhead view of the surfing simulator device of FIG. 2.

FIG. 3 shows an overhead view of the surfing simulator shown in FIG. 2. As shown in this view, elongated bladder 36 extends beyond the width or "beam" of the surfboard. Surfboard widths typically range from 40 to 70 centimeters so a bladder with a length greater than approximately 90 to 100 centimeters would be able to accommodate most surfboards.

Accordingly, as shown in FIGS. 1, 2 and 3, the back of surfboard 46 is placed on spherical bladder 20 and the front of surfboard 46 is placed on elongated bladder 36. Back support retaining strap 28 and front support retaining strap 42 are placed over surfboard 46 and attached to grommets 26 and 40, respectively. Optional nose retaining strap 44 is placed over the nose of surfboard 46. As shown in FIGS. 1 and 2, the elevation of back support spherical bladder 20 is greater than that of front support elongated bladder 36. This provides a natural downward fore-aft slope to surfboard 46. This downward slope is provided to simulate the angle of a surfboard when on a wave; however, the variability of this slope is a feature of the simulator of the present invention.

As will be discussed below, the simulator of the present invention can be adjusted to simulate a variety of surfing conditions so as to accommodate surfers of various skill levels ranging from beginning to advanced surfers.

Figure 4A:
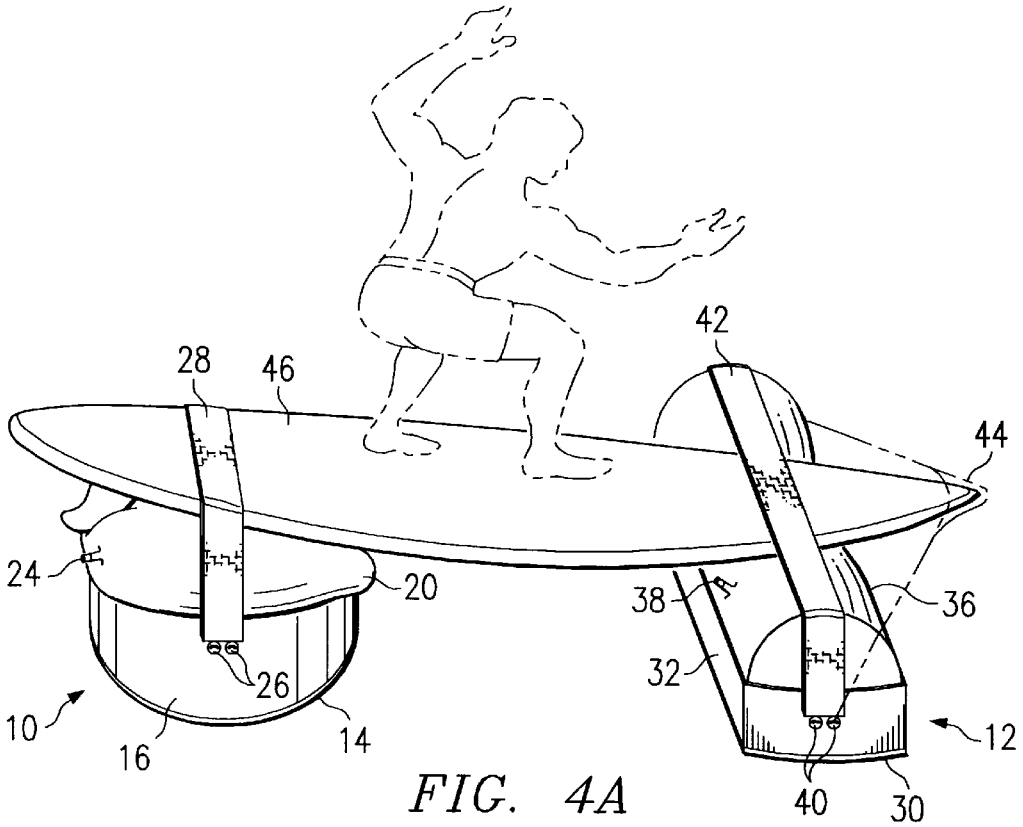
FIG. 4A is a side perspective view of the surfing simulator device of FIG. 2 when adjusted for a beginner surfer.
Figure 4B:
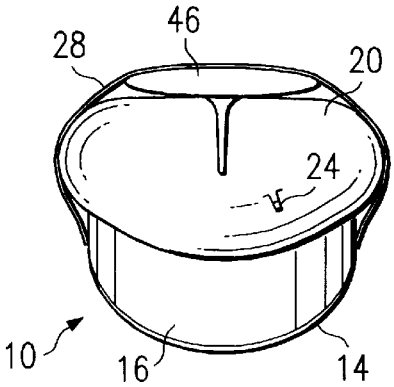
FIG. 4B is a rear view of the rear support member of the surfing simulator device of FIG. 4A.
Figure 4C:
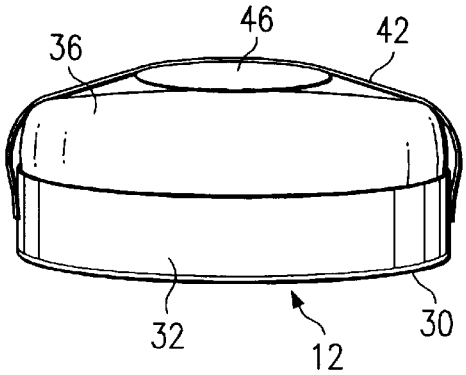
FIG. 4C is a front view of the front support member of the surfing simulator device of FIG. 4A.

For example, a beginning surfer would arrange the simulator as shown in FIGS. 4A, 4B and 4C. In these figures spherical rear support inflatable bladder 20 has a relatively low level of inflation and elongated front support inflatable bladder 36 has a relatively high level of inflation. A rear view of rear support 10 is shown in FIG. 4B. The low level of inflation in spherical bladder 20 lowers the back of surfboard 46 and mitigates the fore-aft angle of surfboard 46. The low level of inflation also attenuates the apex of spherical bladder 20 and mitigates the side-to-side bias of surfboard 46. A front view of front support 12 is shown in FIG. 4C. The relatively high level of inflation in elongated bladder 36 serves to raise the front of surfboard 46, further mitigating the fore-aft angle of surfboard 46. The relatively high level of inflation in elongated bladder 36 also removes any slack in the material of elongated bladder 36. Without any slack in elongated bladder 36, the side-to-side roll of surfboard 46 is limited by the width of surfboard 46 being in contact with the flat upper surface of elongated bladder 36. In other words, when inflated to a relatively high level, the top of elongated bladder 36 provides a semi-rigid stand for the entire width of surfboard 46 which limits it's ability to roll side-to-side. Elongated bladder 36 does not become rigid enough to damage a surfboard, only rigid enough to limit its ability to roll side-to-side.

Figure 5A:
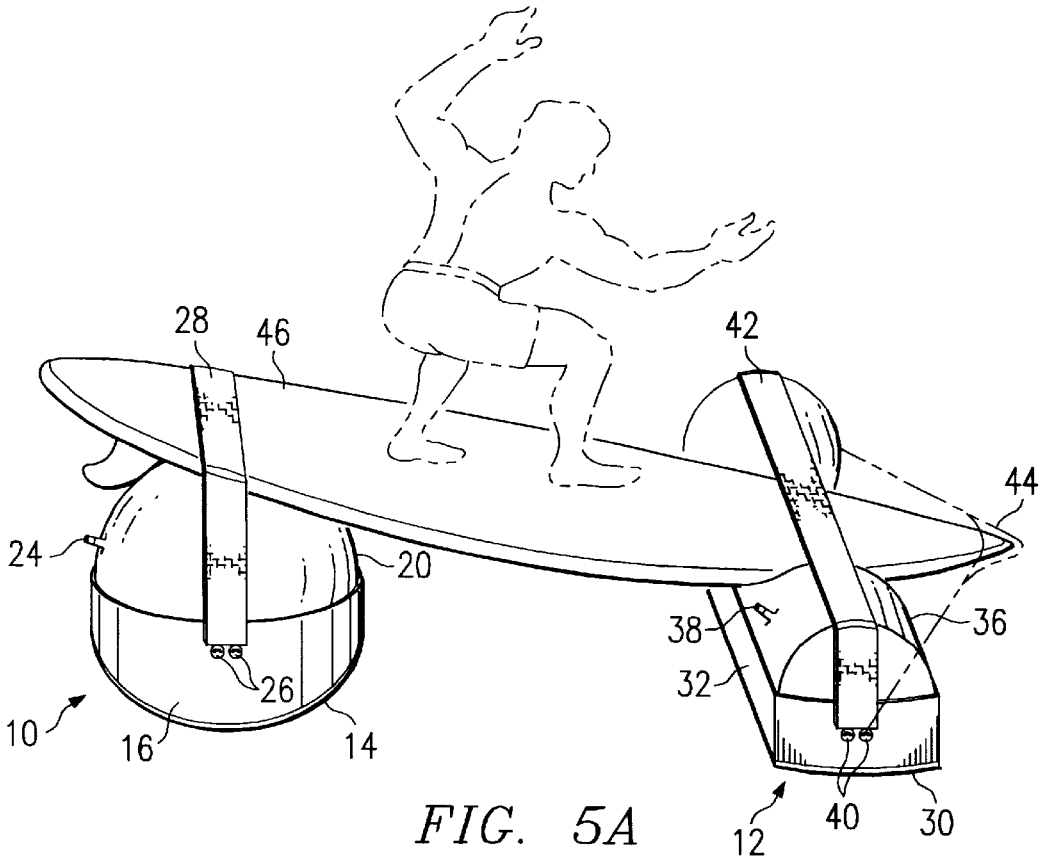
FIG. 5A is a side perspective view of the surfing simulator device of FIG. 2 when adjusted for an advanced surfer.
Figure 5B:
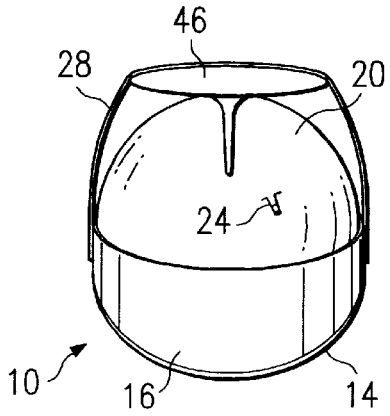
FIG. 5B is a rear view of the rear support member of the surfing simulator device of FIG. 5A.
Figure 5C:
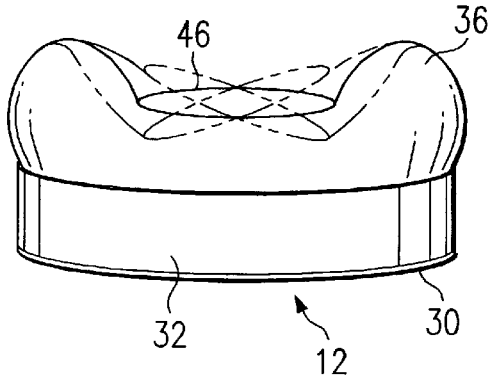
FIG. 5C is a front view of the front support member of the surfing simulator device of FIG. 5A.

A more advanced surfer could arrange the simulator as shown in FIGS. 5A, 5B and 5C. In connection with these figures spherical bladder 20 has a relatively high level of inflation and elongated bladder 36 has a relatively low level of inflation. A rear view of rear support 10 is shown in FIG. 5B. The high level of inflation in spherical bladder 20 serves to elevate the back of surfboard 46, and increase the fore-aft angle of surfboard 46. The high level of inflation in spherical bladder 20 also acts to increase the apex (reduce the contact area) where surfboard 46 seats which increases the side-to-side bias of surfboard 46. A front view of front support 12 is shown in FIG. 5C. The low level of inflation in elongated bladder 36 serves to lower the front of surfboard 46 and increase the fore-aft angle of surfboard 46. As also shown in FIG. 5C, the level of inflation in elongated bladder 36 is low enough to provide slack in elongated bladder 36, that is, it is not inflated enough to assume its relatively flat-topped shape. As such, surfboard 46 when placed on partially inflated bladder 36 has an increased ability to roll side-to-side using the slack in the semi-flaccid bladder while still keeping its entire surface in contact with, and supported by, elongated bladder 36. In other words, by partially inflating elongated bladder 36 the side-to-side bias is increased by the bladders ability to change shape and accommodate the tilting surfboard 46.

Thus, as illustrated by FIGS. 4A–4C and 5A–5C above, the simulator of the present invention provides a method whereby a user can readily simulate different surfing conditions by adjusting the level of inflation in an inflatable bladder. In particular, a surfboard secured to a plurality of adjustable inflatable bladders can simulate a variety of surf conditions. The malleable inflatable bladders spread the load on the surfboard and do not cause damage to it so the surfboard can be used in the water as well. A beginner surfer can practice going from the prone position to the standing position, and, practice remaining in the standing position. A more advanced surfer can adjust the simulator so that it is very unstable with a steep slope to simulate difficult waves. The mechanism of resting the surfboard on an inflated bladder provides a fluid movement to the surfboard that closely resembles the feel of a surfboard in water. The simulator has a high level of variability and can be easily adjusted on the fore-aft axis and side-to-side axis. The adjustability of the simulator can be varied in minute increments and is constrained only by the degree to which the bladders are inflated.

Although the present invention has been discussed above by reference to FIGS. 1 through 5, it will be understood by those of ordinary skill in the art, that the invention can be practiced by employing inflatable bladders of various shapes and sizes that can be inflated with either air or water (or other gases and liquids).

For example, instead of employing a rear bladder that is spherical in shape as shown above, it is possible to employ other shapes as well (for example, conical, cylindrical, elongated, pyramidal, etc.) without deviating from the concept of the present invention. In addition, instead of employing a front bladder that is cylindrical in shape as shown above, it is possible to employ other shapes as well (for example, rectangular, square, oblong, etc.) without deviating from the concept of the present invention. In addition, the shape or elevation of the front and back bladders can be reversed (if so desired). Moreover, if additional support is desired, more than two bladders can be used (for example, a middle bladder) or a single bladder of the proper shape and contact area to support the entire surfboard can be used.

It will be also understood to those of ordinary skill in the art that the present invention can be used to simulate not only surfing, but other board sports as well (for example, snowboarding, skateboarding, and skiing).

In addition, if desired, a pump, bellows, motor or other automatic or manual air, fluid or pressure adjusting means could be attached to one or more of the inflatable bladders to provide rapid cyclical inflation and deflation of such bladders to create more rapid and authentic variability in the fluid-like motion. This will allow the more advanced surfer to practice surfing under a more challenging environment with a device and method that is less expensive and complicated than the prior art.

Thus, a device and method for simulating surfing and other board sports has been disclosed. One skilled in the art will appreciate that the present invention can be practiced by other than the described embodiments, which are presented here for purposes of illustration and not of limitation, and that the present invention is limited only by the claims that follows.

What is claimed is:

1. A simulator apparatus kit for training a user to balance on a board in an athletic simulation, comprising:

(a) a plurality of inflatable bladders each having an upper surface adapted to allow the board to be removably supported thereon said inflatable bladders being selectively spaced relative to one another;

(b) a restraining member to restrain at least one of said inflatable bladders from movement relative to a supporting ground surface;

(c) a means to adjust the level of inflation in at least one of said inflatable bladders so as to allow the user to control the simulation; and (d) a means of removably securing the board to said upper surface of at least one of said inflatable bladders, whereby said kit may be assembled and deployed by the user for athletic simulation use with the board.

2. The simulator apparatus kit of claim 1 wherein one of said inflatable bladders is adapted to support a front end of the board and a second of said inflatable bladders is adapted for supporting a rear end of the board and wherein the rear bladder is at a higher elevation than the front bladder to create an angle on the board.

3. The simulator apparatus kit of claim 2 wherein one of the inflatable bladders has a flat upper surface wider than a standard surfboard and wherein (i) by fully inflating said wider bladder the upper surface becomes semi-rigid mitigating the board's ability to tilt and (ii) by deflating the wider bladder, slack is provided in the upper surface of the bladder allowing the board greater ability to tilt.

4. The simulator apparatus kit of claim 2 wherein one or more of the inflatable bladders rises to an apex, whereby increasing the level of inflation will elevate the board.

5. A simulator apparatus kit for training a user to balance on a board comprising:

(a) a front inflatable bladder having an upper surface adapted to allow a front end of a board to be removably supported thereon;

(b) a rear inflatable bladder having an upper surface adapted to allow a rear end of the board to be removably supported thereon at a higher level than the front end of the board;

(c) a means of adjusting the level of inflation in said front bladder;

(d) a means of adjusting the level of inflation in said rear bladder;

(e) a restraining member to restrain at least one of said bladders from movement relative to a supporting ground surface, said front and rear bladders being selectively spaced relative to one another; and (f) a means of removably securing the board to said upper surface of at least one of said bladders, whereby said kit may be assembled and deployed by the user for sporting simulation use with the hoard.

6. The simulator apparatus kit of claim 5 wherein the bladders can be inflated to different elevations.

7. The simulator apparatus kit of claim 5 wherein the front bladder has a span that is wider than a standard surfboard to control side-to-side roll of the board.

8. The simulator apparatus kit of claim 7 wherein the front bladder is cylindrically shaped.

9. The simulator apparatus kit of claim 5 wherein the rear bladder comes to an apex.

10. The simulator apparatus kit of claim 9 wherein the rear bladder is spherically shaped.

11. A method for training a user to balance on a board comprising the steps of:

(a) providing an inflatable bladder having an upper surface adapted to allow a front end of the board to be removably supported thereon;

(b) placing the board on the bladder;

(c) adjusting the level of inflation of said bladder to accommodate the user's level of skill such that the board is canted forward in use and is not capable of striking the ground or any other non-bladder surface subjacent the board during an athletic simulation;

(d) providing a second inflatable bladder having an upper surface adapted to allow the a rear end of the board to be removably supported thereon;

(e) placing the first inflatable bladder under the front end of the board;

(f) placing the second inflatable bladder under the rear end of the board for supporting the rear end of the board at a higher level than the front end of the board;

(g) adjusting the level of inflation in the first and second bladders to accommodate the user's level of skill such that the board is not capable of striking the ground or any other surface subjacent the board during any phase of the athletic simulation.

12. The method of claim 11 wherein the first bladder has a span that is wider than the board to control side-to-side roll of the board.

13. The method of claim 12 wherein the first bladder is cylindrically shaped.

14. The method of claim 11 wherein the second bladder comes to an apex.

15. The method of claim 14 wherein the second bladder is spherically shaped.

16. The method of claim 11 further including the step of (d) cyclically inflating and deflating the level of inflation of said bladder to provide a more challenging training environment.

17. The method of claim 16 wherein step (d) further comprises coupling an automatic air, fluid, or pressure adjusting means to said inflatable bladder.

18. The method of claim 16 wherein step (d) further comprises coupling an manual air, fluid, or pressure adjusting means to said inflatable bladder.

* * * * *